US005931775A

United States Patent [19]

Smith

[11] Patent Number: 5,931,775

[45] Date of Patent: Aug. 3, 1999

[54] DEVICE FOR TRAINING VAGINAL SPHINCTER MUSCLE

[76] Inventor: Robert H. Smith, 9715 1/2 Lakeshore Blvd. NE., Seattle, Wash. 98115

[21] Appl. No.: 08/962,304

[22] Filed: Oct. 31, 1997

[51] Int. Cl.[6] ..... A63B 21/00

[52] U.S. Cl. ..... 600/29; 600/38

[58] Field of Search ..... 600/29–32, 38, 600/41, 591; 128/830, 833, 834, 839, 845; 482/91, 148

[56] References Cited

U.S. PATENT DOCUMENTS

| | | | |
|---|---|---|---|
| D. 344,314 | 2/1994 | Smith . | |
| 1,928,893 | 10/1933 | Hoard . | |
| 2,763,265 | 9/1956 | Waters . | |
| 3,502,328 | 3/1970 | Hamilton . | |
| 4,241,912 | 12/1980 | Mercer et al. | 482/148 |
| 4,574,791 | 3/1986 | Mitchener . | |
| 4,873,996 | 10/1989 | Maurer . | |
| 4,953,563 | 9/1990 | Kaiser et al. . | |
| 5,354,250 | 10/1994 | Christensen | 482/91 |
| 5,483,832 | 1/1996 | Pauser et al. . | |
| 5,554,092 | 9/1996 | Harpstead et al. | 482/148 |

*Primary Examiner*—Samuel Gilbert
*Attorney, Agent, or Firm*—James D. Givnan, Jr.

[57] ABSTRACT

A device including a disk shaped base having a cylindrical projection thereon about which a resilient sleeve is disposed. The sleeve is subject to partial compression during constriction of the vaginal sphincter muscle with repeated constriction serving to restore muscle tone and strength.

3 Claims, 1 Drawing Sheet

4
4A
7
5
4B
3
1
2
7

4A
4
6
5
7
4B
3
2
1
7

DEVICE FOR TRAINING VAGINAL SPHINCTER MUSCLE

BACKGROUND OF THE INVENTION

The present invention pertains to that class of training aids for the restoration of the vaginal sphincter muscle.

The extensive stretching of such muscles, as for example, during childbirth, lessens the effectiveness of same to control various physiological functions. Muscle function can be restored by exercise through voluntary, repeated contraction of same against the proper resistance.

The prior patents of which the present inventor is aware include various devices insertable into the vagina for the purpose of toning muscles associated therewith and include devices having assembled components displaceable relative to one another and incur a risk of injury while others require considerable expertise in their use.

Examples of such foregoing devices are found in U.S. Pat. Nos. 1,928,893 and 3,502,328, while an item of unitary resilient construction is shown in U.S. Pat. No. 2,763,265.

U.S. Pat. No. 4,574,791 shows inserts as at 12 and 12A which may be of soft flexible material, either hollow or solid and generally of pear shape against which vaginal contractive forces may be exerted.

U.S. Pat. No. 4,873,996 discloses a vaginal insert with electrical components including electrodes imparting electric impulses to vaginal muscles. A condom serves to enclose the device and has electrically conductive elements.

U.S. Pat. No. 4,953,563 shows a vaginal insert having a compressible bulb for vaginal insertion. Compression of the bulb results in actuating an air gauge to determine the extent of bulb compression.

U.S. Pat. No. 3,483,832 shows a probe for insertion into the vagina with the probe being in communication with a gauge to indicate the degree of probe compression.

U.S. Design Pat. No. 344,341 shows an insert of rigid construction for strengthening and toning the vaginal sphincter muscle.

SUMMARY OF THE PRESENT INVENTION

The present invention is embodied in a device for vaginal insertion having a resilient component with limited compression and against which the vaginal sphincter muscle may be voluntarily constricted for toning purposes and strengthening of the muscle.

A base of the device is provided with a projection of a desired crosswise dimension which serves to support thereon a sleeve of resilient material. The resilient material provides a degree of yieldable resistance for maximal muscle contraction which does not occur upon contact with an unyielding surface which results in involuntary relaxing of the muscle. Accordingly toning of the spincter muscle can be safely achieved by daily training periods without risk of injury to the muscle.

DETAILED DESCRIPTION OF THE PREFERRED EMBODIMENTS

Figure 1:
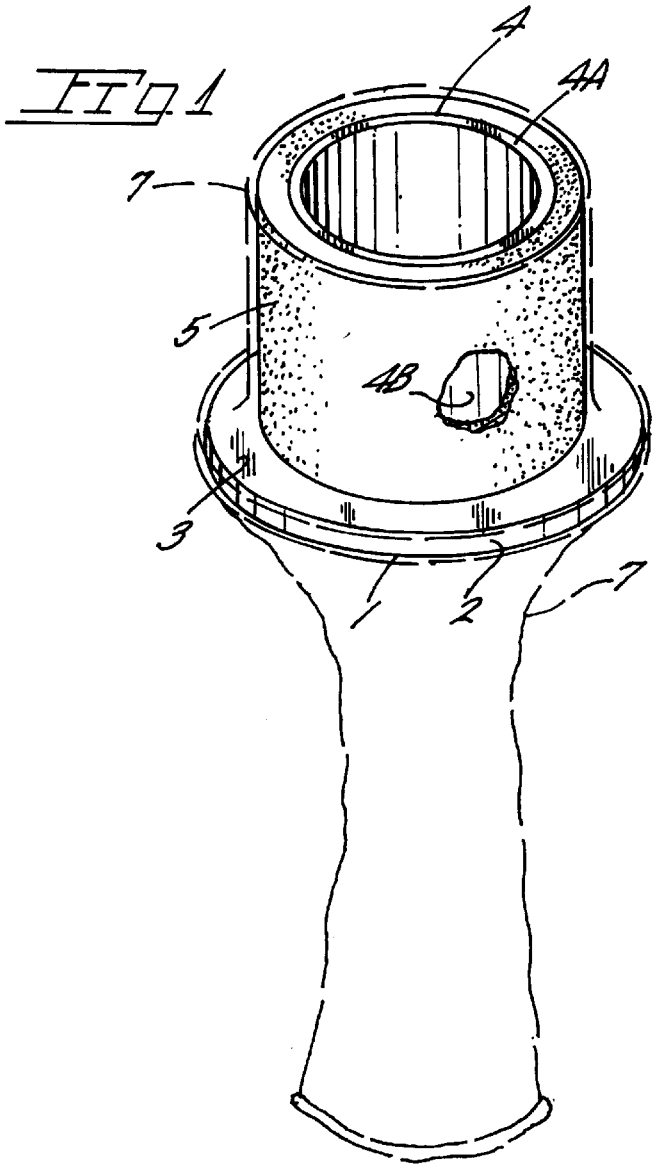
FIG. 1 is a downward perspective of the present training device.
Figure 2:
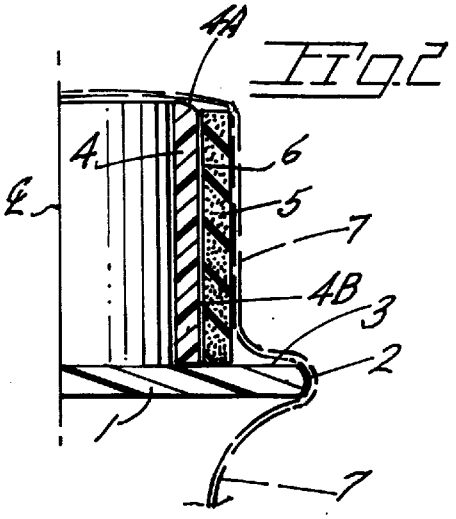
FIG. 2 is a vertical sectional view of the training device broken away along a vertical centerline of the device.

In the accompanying drawings reference numerals thereon indicate parts similarly identified in the following description.

A base 1 is of disk configuration having a perimenter 2 and may be acrylic resin to permit smoothing of the perimeter as by subjecting same to a flame during manufacture. In place on a surface 3 of the base is a cylindrical projection 4 which may also be an acrylic resin and suitably secured to base 1. An upper edge 4A of the projection is preferably also flame treated.

A resilient sleeve 5 is affixed to an outer wall surface 4B of projection 4 and preferably is a synthetic foam of closed cell construction. An adhesive at 6 retains the sleeve in place. A wall thickness of sleeve 5 may be on the order of 3/16 of an inch with sleeve material hardness being of a rating to permit only partial compression of the sleeve during use of the device. Maximal contraction of a sphincter muscle can accordingly be achieved as the muscle does not encounter an injurious unyielding surface during constriction.

A condom at 7, preferably lubricated, serves to shroud the device as well as facilitate handling and use of the device.

Suitable material for resilient sleeve 5 is that sold under the trademark MINICEL manufactured and sold by the VOLTEK Corporation and is a closed cell, chemically crosslinked copolymer. The sleeve is cemented at 6 to the outer surface 4A of projection 4.

The device is provided in a range of sleeve outside diameters to permit insertion of a projection 4 and sleeve 5 in a snug but pain free manner yet causing some degree of stretching the vaginal sphincter short of pain. With the device held in place, the user constricts, to the maximum extent, the muscles of the perineum, abdomen, buttocks and lower back and maintains a maximal contraction as long as possible with the objective being of at least 30 seconds but short of overworking the muscle and any resulting pain.

The frequency of use should be 2 or 3 periods a day with each period including several contractions while avoiding muscle soreness.

Overall or outside diameters of sleeve 5, in place on projection 4, would include a range of sizes, 1⅜; 1⅝; 1⅞ and 2⅛ of an inch with projection 4 having a length of about 1¼ inches or so.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A device for restorative training of the vaginal sphincter muscle and comprising, a base, a projection on said base for insertion into a vagina and having an outer wall surface in an upright relationship to the base, and a sleeve of resilient foam material in place about said outer wall surface and against which the sphincter muscle may momentarily and repeatedly contract to partially compress said sleeve, said sleeve of a hardness rating permitting only partial compression to tone the sphincter muscle without risk of injury to the muscle.

2. The device claimed in claim 1 wherein said sleeve is of closed cell foam material.

3. The device claimed in claim 1 wherein said sleeve is at least of a wall thickness of 3/16 of an inch.

* * * * *